US007923650B2

(12) United States Patent
Greenberg et al.

(10) Patent No.: US 7,923,650 B2
(45) Date of Patent: Apr. 12, 2011

(54) GANGED AUXILIARY SWITCH CONFIGURATION FOR USE IN A MOLDED CASE CIRCUIT BREAKER

(75) Inventors: Randall Lee Greenberg, Granby, CT (US); Girish Mruthunjaya Hassan, Seconderabad (IN); Roger Neil Castonguay, Terryville, CT (US); Dave Scot Christensen, Harwinton, CT (US)

(73) Assignee: General Electric Company, Schenectady, NY (US)

( * ) Notice: Subject to any disclaimer, the term of this patent is extended or adjusted under 35 U.S.C. 154(b) by 1575 days.

(21) Appl. No.: 09/790,848

(22) Filed: Feb. 22, 2001

(65) Prior Publication Data

US 2002/0112946 A1 Aug. 22, 2002

(51) Int. Cl.
*H01H 9/20* (2006.01)

(52) U.S. Cl. ..... 200/50.32; 200/400; 335/132

(58) Field of Classification Search ..... 600/400, 600/401, 50.32; 335/132, 202; 439/594, 439/717

See application file for complete search history.

(56) References Cited

U.S. PATENT DOCUMENTS

| | | | | |
|---|---|---|---|---|
| 4,595,812 | A | 6/1986 | Tamaru et al. | 200/307 |
| 4,622,444 | A | 11/1986 | Kandatsu et al. | 200/303 |
| 4,831,221 | A | 5/1989 | Yu et al. | 200/553 |
| 5,027,091 | A | 6/1991 | Lesslie et al. | 335/132 |
| 5,138,121 | A | 8/1992 | Streich et al. | 200/293 |
| 5,140,115 | A | 8/1992 | Morris | 200/308 |
| 5,361,052 | A | 11/1994 | Ferullo et al. | 335/172 |
| 5,440,088 | A | 8/1995 | Coudert et al. | 200/303 |
| 5,446,386 | A | 8/1995 | Pollman et al. | 324/424 |
| D367,265 | S | 2/1996 | Yamagata et al. | D13/160 |
| 5,539,168 | A | 7/1996 | Linzenich | 200/303 |
| 5,581,219 | A | 12/1996 | Nozawa et al. | 335/132 |
| 5,680,084 | A * | 10/1997 | Kishi et al. | 335/15 |
| 5,804,783 | A * | 9/1998 | Breed | 200/61.45 R |
| 6,232,859 | B1 * | 5/2001 | Christensen et al. | 335/132 |
| 6,284,991 | B1 * | 9/2001 | Fasano et al. | 200/296 |
| 6,332,813 | B1 * | 12/2001 | Okabe et al. | 439/701 |

FOREIGN PATENT DOCUMENTS

FR 2 699 324 6/1994

* cited by examiner

*Primary Examiner* — Lincoln Donovan
*Assistant Examiner* — Lisa N Klaus
(74) *Attorney, Agent, or Firm* — Cantor Colburn LLP

(57) ABSTRACT

A ganged auxiliary switch for a circuit breaker comprises at least two auxiliary switches attached to each other in a side-by-side relationship so that they may be inserted into said circuit breaker as a single unit.

20 Claims, 7 Drawing Sheets

GANGED AUXILIARY SWITCH CONFIGURATION FOR USE IN A MOLDED CASE CIRCUIT BREAKER

BACKGROUND OF THE INVENTION

The present invention relates to the mounting of auxiliary switches in a molded case circuit breaker and, more particularly, to customizing various types of auxiliary switches in a mid-cover of the molded case circuit breaker.

As electrical power distribution systems become more sophisticated, increasing demands are placed on circuit breakers to perform collateral functions in addition to their primary function of circuit protection. The circuit breaker can be customized for use in various applications. The customization is achieved by installing one or more auxiliary switches in the circuit breaker. Conventionally, the auxiliary switch is utilized for indicating the open or closed position of a pair of contacts, or for indicating tripping on a fault, or for any other control or indication function. The auxiliary switch cooperates electrically or mechanically with components of the circuit breaker.

Dependant on the individual demands of the circuit breaker, one or more auxiliary switches are used. When used in a molded case circuit breaker, the space available to accommodate these auxiliary switches is at a premium. To increase the flexibility of the circuit breaker, auxiliary switches are made to fit in small recesses that can support one, two, or three—possibly more—auxiliary switches next to each other in a single recess. This also allows for various accessory devices to be installed which may vary in width. Properly aligning and inserting the auxiliary switches in the recesses requires some minimum level of dexterity. If the auxiliary switch is not properly aligned, or are located with a gap between the switch and the wall of the recess, then there is a potential that there will be insufficient room remaining to insert an adjacent auxiliary switch.

It is therefore desirable to provide a mechanism to improve the placement of auxiliary switches in circuit breaker auxiliary switch recesses.

BRIEF SUMMARY OF THE INVENTION

The above discussed and other drawbacks and deficiencies of the prior art are overcome or alleviated by a ganged auxiliary switch for a circuit breaker comprising at least two auxiliary switches attached to each other in a side-by-side relationship so that they may be inserted into said circuit breaker as a single unit.

BRIEF DESCRIPTION OF THE DRAWINGS

Referring now to the drawings wherein like elements are numbered alike in the several Figures.

DETAILED DESCRIPTION OF THE INVENTION

Figure 1:
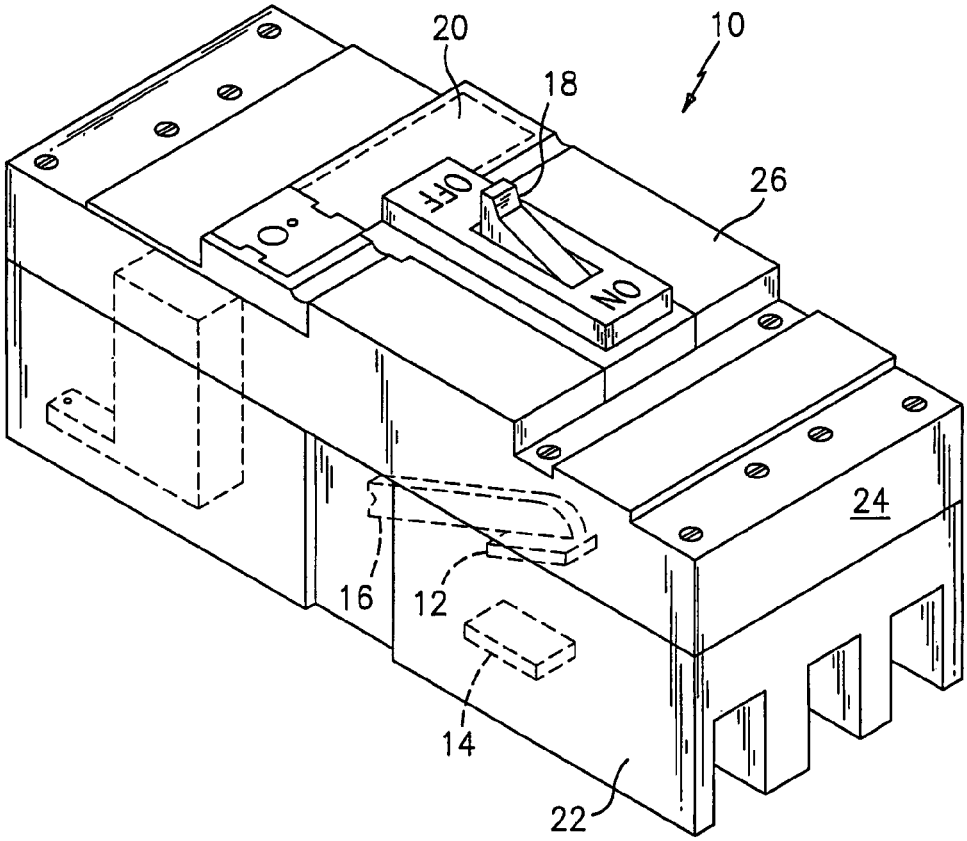
FIG. 1 is a perspective view of an exemplary assembled circuit breaker.

FIG. 1 shows an exemplary molded case circuit breaker 10. As is well understood in the art, circuit breaker 10 includes at least one movable contact 12 and a corresponding number of fixed contacts 14, only one pair shown for illustration purposes. Each movable contact 14 is connected to a corresponding movable contact arm 16. The movable contacts 12 and fixed contacts 14 are electrically connected to corresponding load strap and supply straps (not shown) attached to circuit breaker 10. Circuit breaker 10 includes a housing 22, a mid-cover 24 and a top-cover 26 for housing and containing the various components within. As is generally understood in the art, circuit breaker 10 also comprises an operating mechanism (not shown) within housing 22 for actuating the moveable contact arm or arms 16. The operating mechanism includes handle 18 for manually actuating movable contact arm 16. Additionally, movable contact arm 16 may be automatically actuated in response to a trip signal from electronic trip unit 20. Other means may be utilized for actuating movable contact arm 16 as is generally understood in the art.

Figure 2:
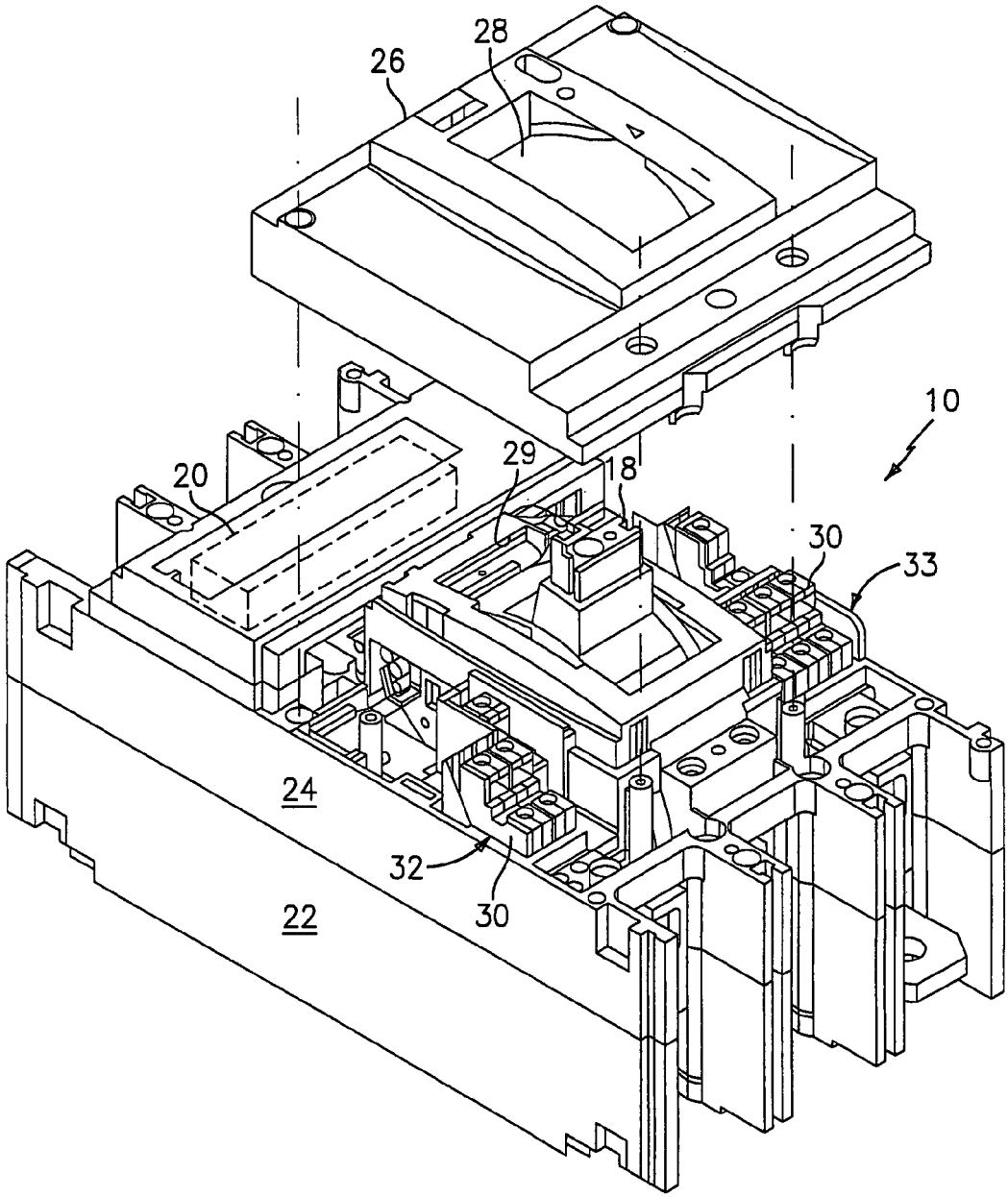
FIG. 2 is a perspective view of the circuit breaker of FIG. 2 with several auxiliary switches lifted from the midcover.

FIG. 2 shows another exemplary molded case circuit breaker with the top-cover 26 removed exposing components housed in mid-cover 24. Handle 18 normally protrudes through opening 28 in top-cover 26 when it is in place. Similarly, handle 18 extends through a corresponding opening 29 in mid-cover 24 where handle 18 interacts with the aforementioned operating mechanism. Auxiliary switches 30 are shown positioned in recesses in mid-cover 24 on either side of handle 18.

The term "auxiliary switch" is used herein to generally indicate an auxiliary switch or auxiliary accessory unit used for indicating the open or closed position of the fixed contacts 14 and movable contacts 12, or for indicating tripping on a fault, or for any other control or indication function. For example, auxiliary switch 30 may be a bell alarm mechanism switch or a bell alarm trip switch.

In the exemplary molded case circuit breaker 10 shown in FIG. 2, the recesses available for accepting auxiliary switches are of varying size. Thus, at location 32, the recess is sufficiently sized for two auxiliary switches as shown, while at location 33, the recess is sufficiently sized for three auxiliary switches as shown.

Figure 3:
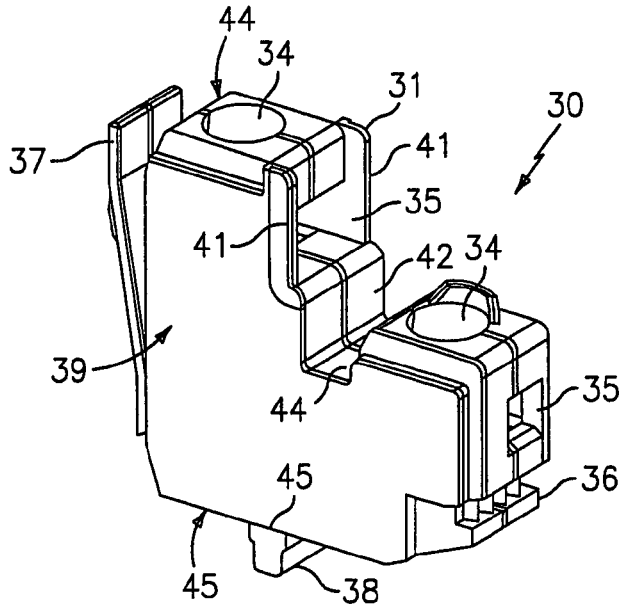
FIG. 3 is a perspective view of an auxiliary switch detail.

FIG. 3 shows a detail view of an exemplary auxiliary switch unit described herein for illustrative purposes only. Auxiliary switch 30 is secured into recesses formed in mid-cover 24 of circuit breaker 10 by way of front lip 36 and rear clip 37. Removal requires that rear clip 37 be deformed inward toward body 31 of auxiliary switch 30. Screws within screw-holes 34 secure wires (not shown) extending into wireways 35. Plunger 38 is spring-biased to extend from body 31 of auxiliary switch 30. As is generally understood in the art, plunger 38 will interact with a lever or other moving part of circuit breaker 10 to either make or break a circuit formed in part by the switching parts within.

Auxiliary switch 30 has two flat sides 39 (only one being visible in FIG. 3). One or both sides will abut adjacently disposed auxiliary switches when multiple switches are inserted adjacent to each other in the recesses of mid-cover 24. Multiple auxiliary switches 30 may be ganged, i.e., attached to each other, to aid in aligning and inserting auxiliary switches 30 in the above-mentioned recesses.

Figure 4:
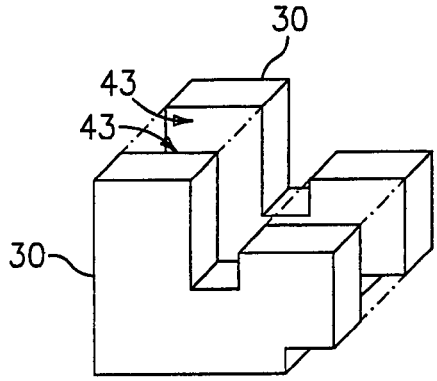
FIG. 4 is a schematic view of two auxiliary switches being brought together.
Figure 5:
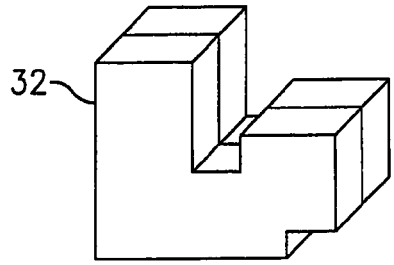
FIG. 5 is a schematic view of a pair of ganged auxiliary switches.

Several methods of ganging two or more auxiliary switches 30 together are contemplated. In one embodiment, two or more auxiliary switches 30, shown in FIG. 4, are ganged together by applying adhesive on facing surfaces 43 and bringing auxiliary switches together as shown in FIG. 5. Alternatively, auxiliary switches 30 may be welded together using known plastics welding techniques, such as ultrasonic welding, other friction welding techniques, and other known welding techniques.

Figure 6:
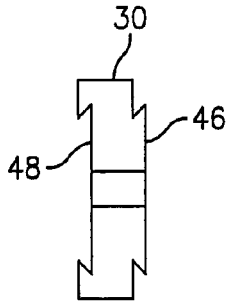
FIG. 6 is a top view of an exemplary auxiliary switch having a dove-tail arrangement.
Figure 7:
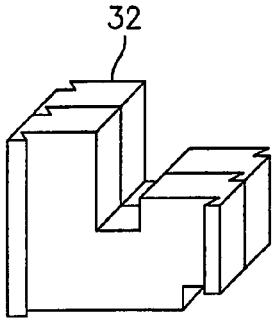
FIG. 7 shows a pair of ganged auxiliary switches having the dovetail arrangement of FIG. 7.

In an alternative embodiment, a dovetail arrangement is employed to facilitate ganging. For example, FIG. 6 shows a top view of an auxiliary switch 30 having a dovetail arrangement comprising a single tongue 46 on one side of auxiliary switch 30 and a single mating groove 48 on an opposite side of auxiliary switch 30. One can recognize that a plurality of parallel dovetails may be similarly employed. The tongue 46 on a first side are matable with mating groove 48 on an opposite side of an adjacent auxiliary switch 30 as shown by example of a pair of ganged auxiliary switches 32 of FIG. 7.

Figure 8:
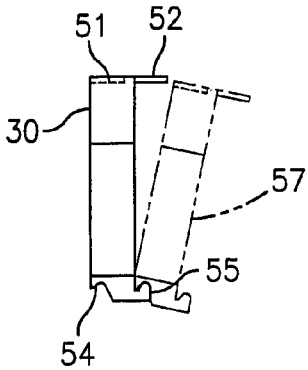
FIG. 8 is a front view of an exemplary auxiliary switch having a clip arrangement.
Figure 9:
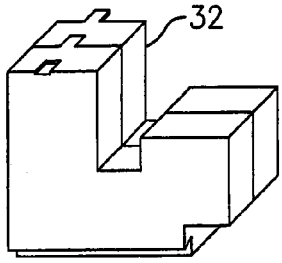
FIG. 9 shows a pair of ganged auxiliary switches having the clip arrangement of FIG. 8.

In another alternative embodiment, two or more auxiliary switches 30 are ganged using a clip arrangement such as that exemplified in FIGS. 8 and 9. Here, each auxiliary switch 30 is provided a tab 52 and lip 55 on a first side, and matable groove 54 and nub 51 on an opposite side. As shown in a front elevation view by FIG. 8, a mating auxiliary switch 57, shown in phantom, can be attached to auxiliary switch 30 by engaging lip 55 of auxiliary switch 30 with groove 54 of mating auxiliary switch 57, then rotating mating auxiliary switch 57 until tab 52 of auxiliary switch 30 snaps into engagement with nub 51 of mating auxiliary switch 57. A ganged auxiliary switch 32 is shown in FIG. 9 having this exemplary clip configuration. One can appreciate that, in place of a lip and tab configuration, a plurality of tabs can be employed, and their locations can be altered from that shown in FIGS. 8 and 9. Referring to FIG. 3, tabs can be formed extending from any available part of body 31 of auxiliary switch 30. For example, a clip can be formed extending from intermediate surface 42, rear surface 44, and/or bottom surface 45.

Figure 10:
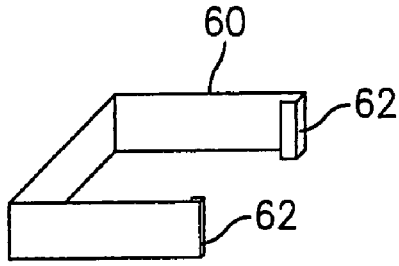
FIG. 10 shows an exemplary clip for another embodiment of a clip arrangement.
Figure 11:
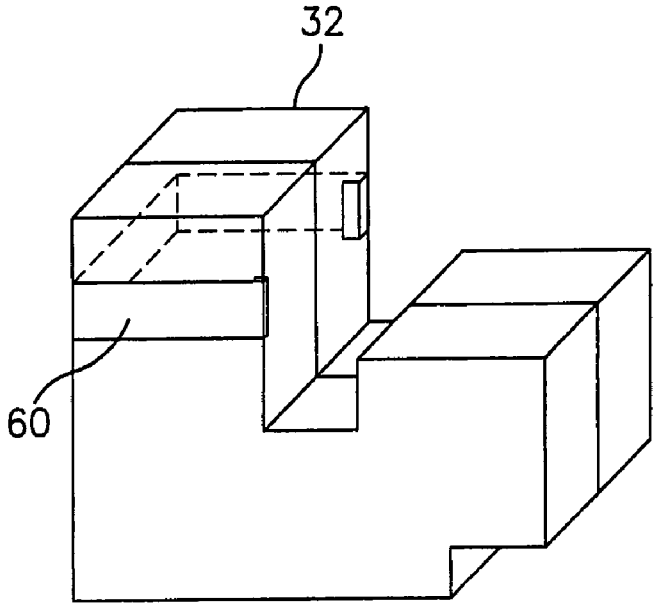
FIG. 11 shows a pair of ganged auxiliary switches using the clip of FIG. 10.

In another alternative embodiment, two or more auxiliary switches 30 are ganged using a separate clip element to hold plural auxiliary switches together. FIG. 10 shows an exemplary clip 60 in perspective view suitable for holding two auxiliary switches 30 together. In this case, clip 60 is simply formed of metal. However, plastic clips could be fashioned to serve this purpose as well. Clip 60 can thus be formed of any suitable material and can easily be adapted for holding three or more auxiliary switches 30 together. Clip 60 fits over two or more auxiliary switches and captures outside lips 41 (FIG. 3) as shown in FIG. 11. Other clip arrangements are possible, as would occur to a person of ordinary skill. For example, a clip could be designed to straddle two or more auxiliary switches 30 across surface 44, and extending on opposite sides to capture lower corners 45.

Figure 12:
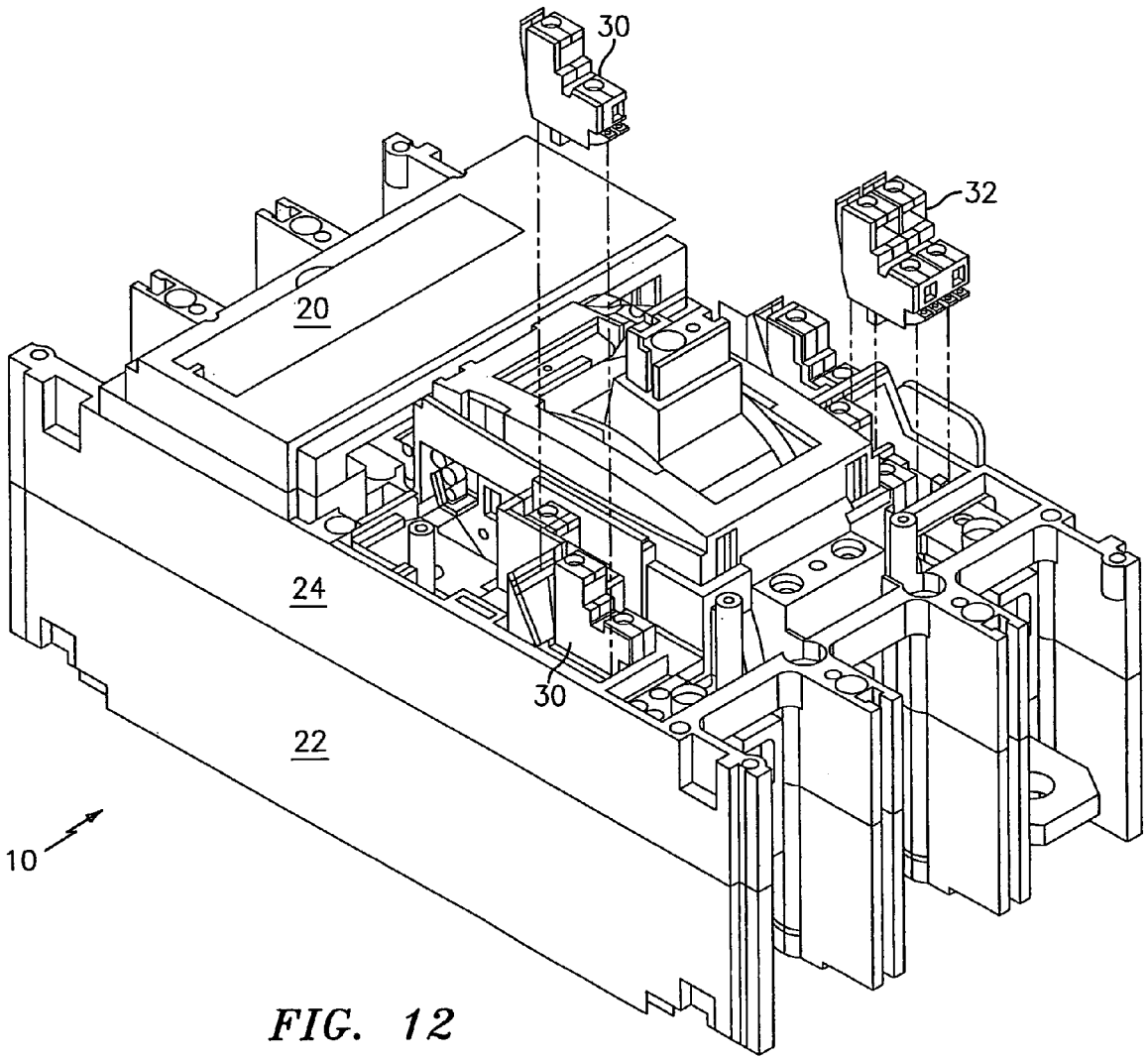
FIG. 12 shows an exemplary circuit breaker with a ganged auxiliary switch and an auxiliary switch not ganged being inserted into an auxiliary switch recess bay.

Auxiliary switches may be ganged when they are produced or prior to being shipped using adhesive or welding techniques such as are described above, or the less permanent ganging arrangements as described above. In this case, installation requires only that the ganged auxiliary switch 32 is inserted as shown in FIG. 12. Ganged auxiliary switches may be inserted along side auxiliary switches that are not ganged as shown.

Figure 13:
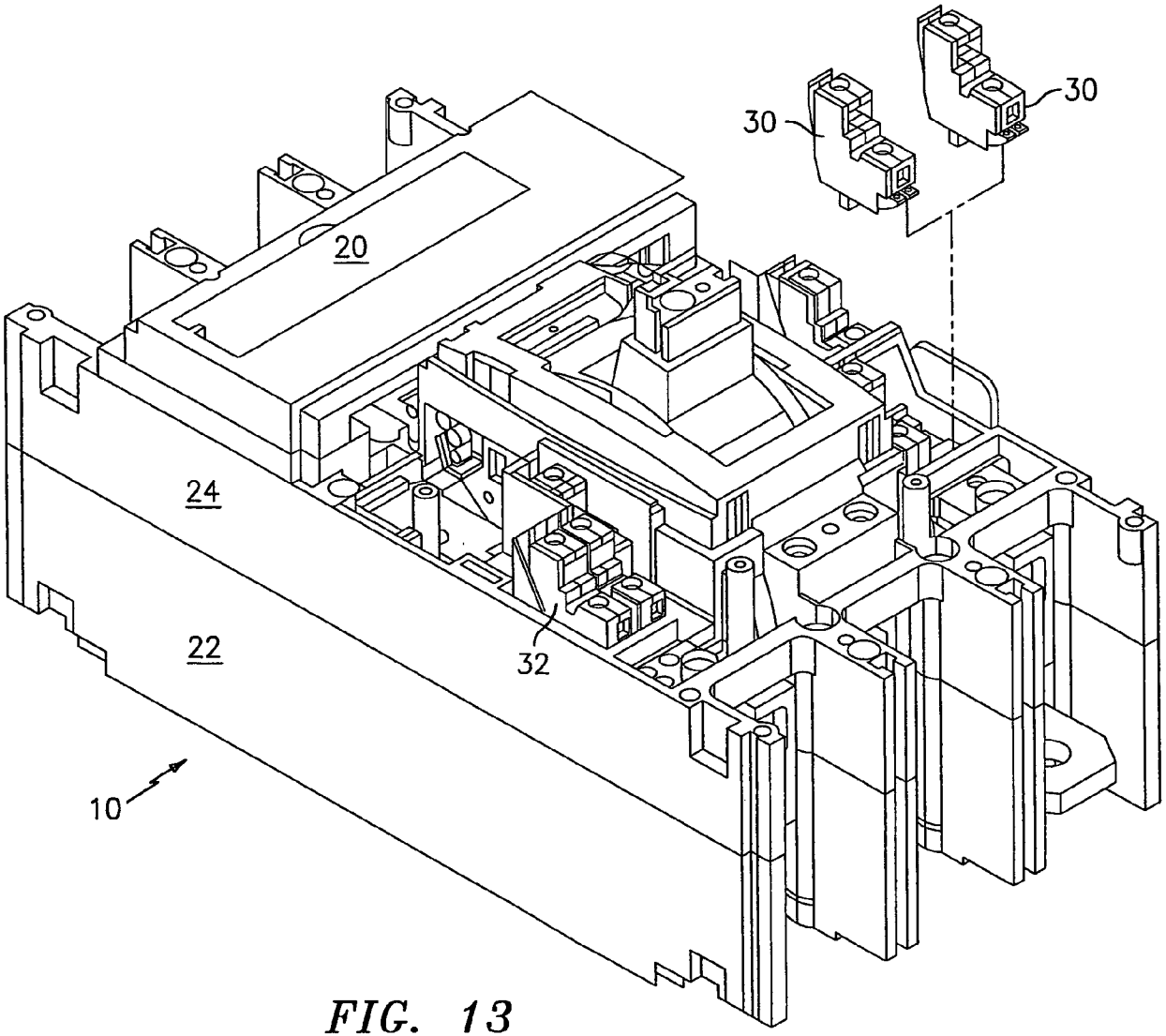
FIG. 13 shows an exemplary circuit breaker with a pair of gangable auxiliary switches being ganged and inserted into an auxiliary switch recess bay.

In the case of using a less permanent means for ganging, e.g., using a clip arrangement or dovetail arrangement, etc., auxiliary switches 30 may be ganged in the field at the time of installation. In this case, two or more auxiliary switches 30 are first ganged, and then inserted into a circuit breaker 10, as shown in FIG. 13.

While the invention has been described with reference to the referred embodiments it will be understood by those skilled in the art that various changes may be made and equivalents may be substituted for elements thereof without departing from the scope of invention. In addition, many modifications may be made to adapt a particular situation or material to the teachings of the invention without departing from the essential scope thereof. Therefore, it is intended that the invention not be limited to the particular embodiment disclosed as the best mode contemplated for carrying out this invention, but that the invention will include all embodiments falling within the scope of the appended claims.

What is claimed is:

1. A ganged auxiliary switch for a circuit breaker, the ganged auxiliary switch comprising:

at least two auxiliary switches; and means for attaching said at least two auxiliary switches together in a side-by-side relationship so that said at least two auxiliary switches are allowed to be removed and inserted into said circuit breaker as a single unit.

2. The ganged auxiliary switch set forth in claim 1 wherein said means for attaching includes permanent welding.

3. The ganged auxiliary switch set forth in claim 2 wherein said permanent welding comprises friction welding.

4. The ganged auxiliary switch set forth in claim 1 wherein said means for attaching comprises adhesive.

5. The ganged auxiliary switch set forth in claim 1 wherein said means for attaching comprises a clip arrangement formed into a body of each of said at least two auxiliary switches.

6. The ganged auxiliary switch set forth in claim 1 wherein said means for attaching comprises a clip for holding said at least two auxiliary switches together.

7. The ganged auxiliary switch set forth in claim 6 wherein said clip comprises a metal clip holding said at least two auxiliary switches together.

8. The ganged auxiliary switch set forth in claim 6 wherein said clip comprises:

a first portion extending across said at least two auxiliary switches; and second portions extending from said first portion, said second portions capture said at least two auxiliary switches for attaching said at least two auxiliary switches together.

9. The ganged auxiliary switch set forth in claim 1 wherein said means for attaching comprises a dovetail arrangement, each of said at least two auxiliary switches having at least one tongue on a first side and at least one mating groove formed on a second side of a body of said at least two auxiliary switches.

10. A circuit breaker comprising:

a housing;

a fixed contact in said housing, said fixed contact being in electrical communication with a first external line strap;

a movable contact in said contact, said movable contact being in electrical communication with a second external line strap;

an operating mechanism for opening and closing said fixed contact and said second contact;

a recess for supporting at least two adjacent auxiliary switches;

a ganged auxiliary switch supported by said recess, said ganged auxiliary switch comprising:

at least two auxiliary switches; and means for attaching said at least two auxiliary switches together in a side-by-side relationship so that said at least two auxiliary switches are allowed to be removed and inserted into said circuit breaker as a unit.

11. The circuit breaker of claim 10 wherein said means for attaching includes permanent welding.

12. The circuit breaker of claim 11 wherein said permanent welding comprises friction welding.

13. The circuit breaker of claim 11, wherein said means for attaching comprising adhesive.

14. The circuit breaker of claim 11, wherein said means for attaching comprises a clip arrangement formed into a body of each of said at least two auxiliary switches.

15. The circuit breaker of claim 11, wherein said means for attaching comprises a clip for holding said at least two auxiliary switches together.

16. The circuit breaker of claim 15, wherein said clip comprises a metal clip holding said at least two auxiliary switches together.

17. The circuit breaker of claim 15, wherein said clip comprises:

a first portion extending across said at least two auxiliary switches; and second portions extending from said first portion, said second portions capture said at least two auxiliary switches for attaching said at least two auxiliary switches together.

18. The circuit breaker of claim 11, wherein said means for attaching comprises a dovetail arrangement, each of said at least two auxiliary switches having at least one tongue on a first side and at least one mating groove formed on a second side of a body of said at least two auxiliary switches.

19. A method for installing auxiliary switches into a circuit breaker comprising:

exposing a recess in said circuit breaker for receiving at least two adjacent auxiliary switches;

attaching at least two auxiliary switches together in side-by-side relationship to form a ganged auxiliary switch;

inserting said ganged auxiliary switch into said recess as a unit.

20. The method of claim 19 wherein said attaching includes clipping said at least two auxiliary switches together.

* * * * *